United States Patent [19]

Zysset

[11] Patent Number: 4,511,299

[45] Date of Patent: Apr. 16, 1985

[54] PULL-TAB FORMING METHOD

[75] Inventor: Edgar H. Zysset, St. Cloud, Fla.

[73] Assignee: Automated Container Corporation, Orlando, Fla.

[21] Appl. No.: 528,584

[22] Filed: Sep. 1, 1983

[51] Int. Cl.[3] ..... B21D 51/00

[52] U.S. Cl. ..... 413/12; 413/14; 413/17; 220/276

[58] Field of Search ..... 413/12, 14, 17, 67, 413/68; 220/276, 269, 270, 272, 273

[56] References Cited

U.S. PATENT DOCUMENTS

| | | | |
|---|---|---|---|
| 804,845 | 11/1905 | Hodgson | 413/12 |
| 2,112,231 | 3/1938 | Sperctel | 413/12 |
| 3,411,470 | 11/1968 | Faage | 413/12 |
| 3,838,788 | 10/1974 | Stargell | 220/276 |
| 3,875,884 | 4/1975 | Zundel | 413/12 |
| 3,981,412 | 9/1976 | Asmes | 220/276 |
| 4,159,061 | 6/1979 | Cornelius | 220/276 |
| 4,276,843 | 7/1981 | Hansen | 413/12 |

*Primary Examiner*—Leon Gilden

*Attorney, Agent, or Firm*—Duckworth, Allen, Dyer & Pettis

[57] ABSTRACT

An easy open pull-tab container and related method comprises a generally planar end having a line of weakness defining a tear line so that a portion of the end is partially removable, the tear line lying in the plane of the end. A pull-tab is provided for severing the portion along the tear line, with first and second portions of the end wall on opposite sides of, and spaced from the line of weakness, extending underneath the area adjacent the line of weakness and to form blunt, protective shoulders at the line of weakness. The protective shoulders are formed via first and second concentric grooves in the end, the grooves extending below the level of the end to form inner and outer beads, the inner bead extending substantially below the outer bead. A central bead is formed in the end between the first and second concentric grooves, the central head extending above the level of the end. The inner and outer beads are forced towards each other and toward the plane of the end until the inner and outer beads abut the center bead, but are spaced a distance apart approximately equal to the line of weakness.

9 Claims, 7 Drawing Figures

PULL-TAB FORMING METHOD

BACKGROUND OF THE INVENTION

1. Field of the Invention

The present invention relates generally to containers, and particularly relates to containers of the type having an easy-open end operable by a pull-tab mechanism.

2. Description of the Prior Art

There is a class of easy-open containers utilizing a construction wherein a manually removable section is incorporated in one end of the container. In this type of construction, the removable section is defined by a line of weakness, usually a score line, which when ruptured by operation of a pull-tab produces sharp edges which remain on both the container and the removed portion. If these sharp edges are permitted to remain unprotected, it frequently occurs that the person opening the container or subsequent users may be cut by the sharp edges.

Prior art constructions depicting techniques for employing a blunt shoulder-type construction underneath the sharp edges to protect against cutting include U.S. Pat. Nos. 3,853,080 to Zundel, and 3,825,149 to Brown et al. The following additional U.S. Pat. Nos. are also of interest: 1,146,327; 2,700,355; 3,186,583; 3,303,958; 3,434,623; 1,736,422; 3,630,408; and 3,757,989.

SUMMARY OF THE INVENTION

The present invention contemplates an easy-open pull-tab container construction and method which solves certain deficiencies in prior art constructions.

In accordance with the present invention, a method for forming a container having a pull-tab removable end includes the steps of providing a can end having a peripheral edge and a generally flat panel. The panel has opposing first and second sides with the first side adapted to face toward the inside of the container when the end is affixed thereto. First and second concentric grooves are formed in the panel spaced from the peripheral edge, the grooves extending below the level of the first side to form inner and outer beads. A central bead is formed in the panel between the first and second concentric grooves, the central bead extending above the level of the second surface with a score line formed along that central bead. The inner and outer beads are forced towards each other and toward the first surface of the panel, and the central bead is forced toward the second surface until the inner and outer beads abut the central bead with the score line lying in the plane of the panel, and with the inner and outer beads lying substantially parallel to but below the plane of the panel. A pull-tab is fixed to the end, the pull-tab having means for severing the end along the score line.

In accordance with the method of the present invention, the inner bead is extended a greater distance away from the first surface than the second bead during the forming steps.

The easy-open container end construction in accordance with the present invention contemplates a generally planar end having a line of weakness (e.g. a score line) defining a tear line for the end so that a portion of the end is at least partially removable, the tear line lying in the plane of the end. Means, such as pull-tab, is provided for severing the removable portion along the tear line. First and second portions of the end on opposite sides of, and spaced from the line of weakness extend underneath the area adjacent the line of weakness to form blunt, protective shoulders at the line of weakness. The protective shoulders lie in a common plane which is substantially parallel to, but spaced from the plane of the end.

In accordance with the present invention, the completed construction of the container end provides that the bead containing the line of weakness lies in the plane of the end, with concentric recesses in the end above the first and second portions forming the protective shoulders.

DESCRIPTION OF PREFERRED EMBODIMENT

The method of the present invention will now be described with reference to FIGS. 1–6.

Figure 1:
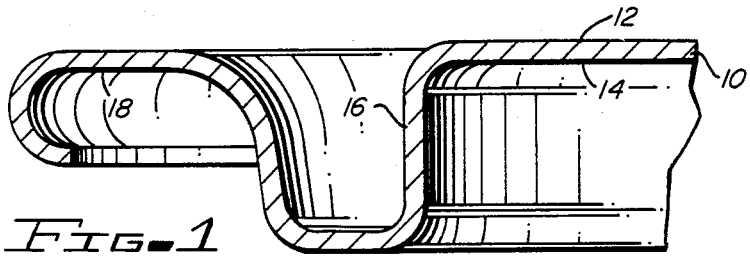
FIGS. 1–6 are cross-sections illustrating steps in the method of forming the container construction of the present invention.
Figure 2:
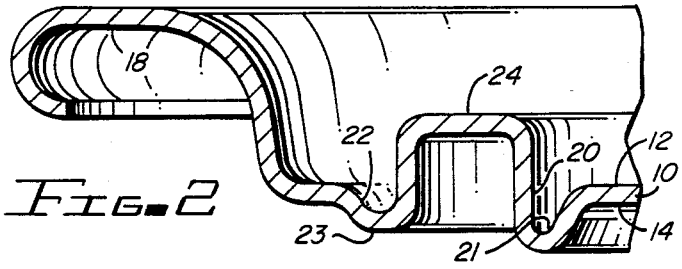

Noting FIG. 1, the starting material is a planar can end blank. The end, referred to generally by the reference numeral 10, is subjected to a first bending step to form bend 16 and a portion of side curl 18 at the peripheral edge of the end. As is shown in FIG. 2, the end is then subjected to another bending and forming step to create a pair of concentric grooves 20, 22 which define inner and outer beads 21, 23 extending below the second, inner surface 14 of the end 10. Also formed is a central bead 24, the bead 24 extending above the level of the first, outer surface 12 of the end 10. As is shown in FIG. 2, the groove 20 (and as a consequence the bead 21) extends a greater distance below the level of the second surface 14 than the outer bead 23. This dimensional characteristic is provided to insure sufficient metal on the inside of the tear area as opposed to the outside area.

Figure 3:
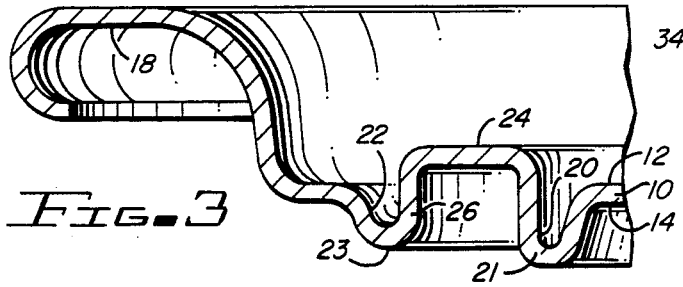
Figure 4:
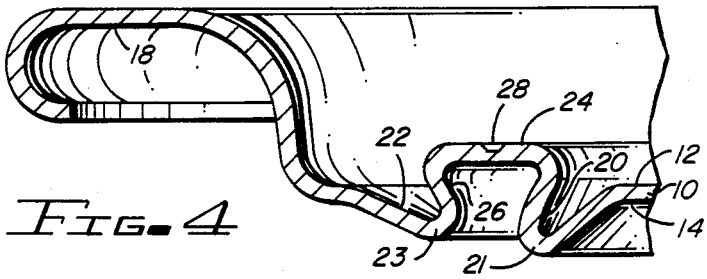
Figure 5:
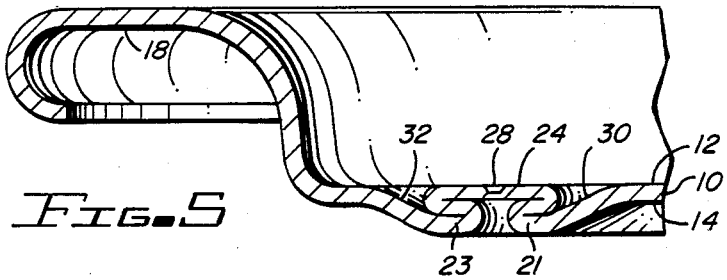
Figure 6:
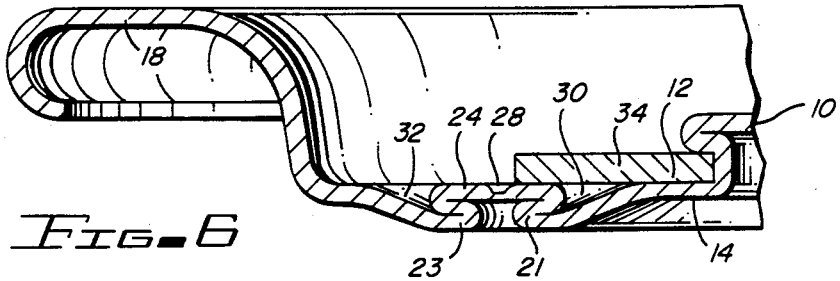

Referring now to FIG. 3, the end 10 is subjected to another forming step wherein the portion of the end 10 inside the bead 21 is rolled upward, and the second bead 23 is extended downwardly. Thereafter, as is shown in FIG. 4, the inner and outer beads 21, 23 are forced toward the inside surface 14 and the central bead 24 is forced toward the outside surface 12 until the inner and outer beads 21, 23 abut the central bead 24 to provide blunt, protective shoulders underneath the score line 28 (see FIG. 5). The protective shoulders formed by the inner and outer beads 21, 23 lie in a common plane which is substantially parallel to, but spaced from the plane of the end 10. As is shown in FIG. 6, the completed end is provided with a pull-tab 34, the extremity of which extends adjacent to the score line 28 to permit the end to be opened in a conventional manner.

As is further illustrated in FIG. 6, the completed end fabricated in accordance with the method shown in FIGS. 1–5 provides the central bead 24 lying essentially in the plane of the end 10, and with concentric recesses 30, 32 surrounding the central bead; the recesses 30, 32 are formed by the specific bending technique described below with respect to the inner and outer beads 21, 23.

Figure 7:
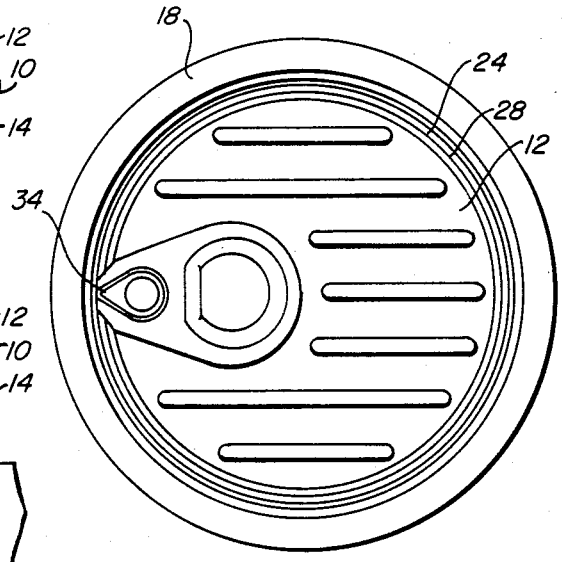
FIG. 7 is a top plan view of the end construction in accordance with the present invention.

As is shown in FIG. 7, the completed end 10 provides a central bead 24 containing the score line which is flush with the end 10 so as to ease the function of the tab mechanism, and further provides for reduction in complexity in manufacturing.

I claim:

1. A method for forming a container having a pull-tab removable end, said method comprising the steps of:

(a) providing a can end having a peripheral edge and a generally flat panel, said panel having opposing first and second sides with said first side adapted to face toward the inside of the container when said end is affixed thereto;

(b) forming first and second concentric grooves in said panel spaced from said peripheral edge, said grooves extending below the level of said first side to form inner and outer beads;

(c) forming a central bead in said panel between said first and second concentric grooves, said central bead extending above the level of said second surface;

(d) forming a score along said central bead;

(e) forcing said inner and outer beads toward each other and then toward said first surface and said central bead toward said second surface until said inner and outer beads abut said central bead; and (f) fixing a pull-tab to said end, said pull-tab having means for severing said end along said score.

2. The method recited in claim 1 wherein the peripheral edges of said central bead overlap said inner and outer beads after said forcing step.

3. The method recited in claim 2 wherein the extremities of said inner and outer beads lie under said score after said forcing step.

4. The method recited in claim 1 wherein said pull-tab has a forward extremity, said fixing step including attaching said pull-tab to said panel at said second surface inside said inner bead with said forward extremity positioned at said score, whereby movement of said forward extremity toward said central bead causing severing along said score line.

5. The method recited in claim 1 further comprising the steps of forcing said central bead toward said flat panel until the top of said central bead lies generally in the plane of said second surface, whereby a pair of concentric inner and outer recesses are formed in said second surface around the peripheral edges of said central bead.

6. The method recited in claim 1 further comprising the step of forming a curl along said peripheral edge of said end for engaging said end with the peripheral wall of the container.

7. The method recited in claim 1 further comprising the step of extending said inner bead a greater distance away from said first surface than said outer bead.

8. A method for forming a container having a pull-tab removable end, said method comprising the steps of:

(a) providing a metallic can end;

(b) forming inner and outer concentric beads in said end extending away from said end, the inner bead extending a greater distance away from said end than said outer bead;

(c) forming a score between said inner and outer beads;

(d) forcing said inner and outer beads toward each other and toward the plane of said end until said beads abut said end; and (e) fixing a pull-tab to said end, said pull-tab having means for severing said end along said score.

9. The method recited in claim 8 further comprising the step of forming concentric recesses in said end over said abutted inner and outer beads.

* * * * *